United States Patent [19]

Austin

[11] 4,405,071

[45] Sep. 20, 1983

[54] FASTENER DRIVING TOOL

[75] Inventor: Ronald Austin, Hazelcrest, Ill.

[73] Assignee: Duo-Fast Corporation, Franklin Park, Ill.

[21] Appl. No.: 301,958

[22] Filed: Sep. 14, 1981

[51] Int. Cl.[3] ..... B27F 7/02

[52] U.S. Cl. ..... 227/7; 227/8; 227/132

[58] Field of Search ..... 227/8, 9, 7, 132

[56] References Cited

U.S. PATENT DOCUMENTS 4,323,127 4/1982 Cunningham ..... 227/8 X 4,351,464 9/1982 Fehrs et al. ..... 227/8 X

*Primary Examiner*—Mark Rosenbaum

*Attorney, Agent, or Firm*—Mason, Kolehmainen, Rathburn & Wyss

[57] ABSTRACT

A fastener driving tool for driving fasteners into a workpiece includes a trigger assembly movable from an inoperative position to an operative position and a workpiece responsive assembly also movable from an inoperative position to an operative position as the tool is moved adjacent the workpiece. The tool further includes a safety control assembly coupling the trigger and workpiece responsive assemblies to control operation of the tool. The safety control assembly includes a blocking member that blocks the movement of the workpiece responsive assembly if the trigger assembly is actuated prior to placement of the tool on a workpiece.

12 Claims, 7 Drawing Figures

FIG. 3
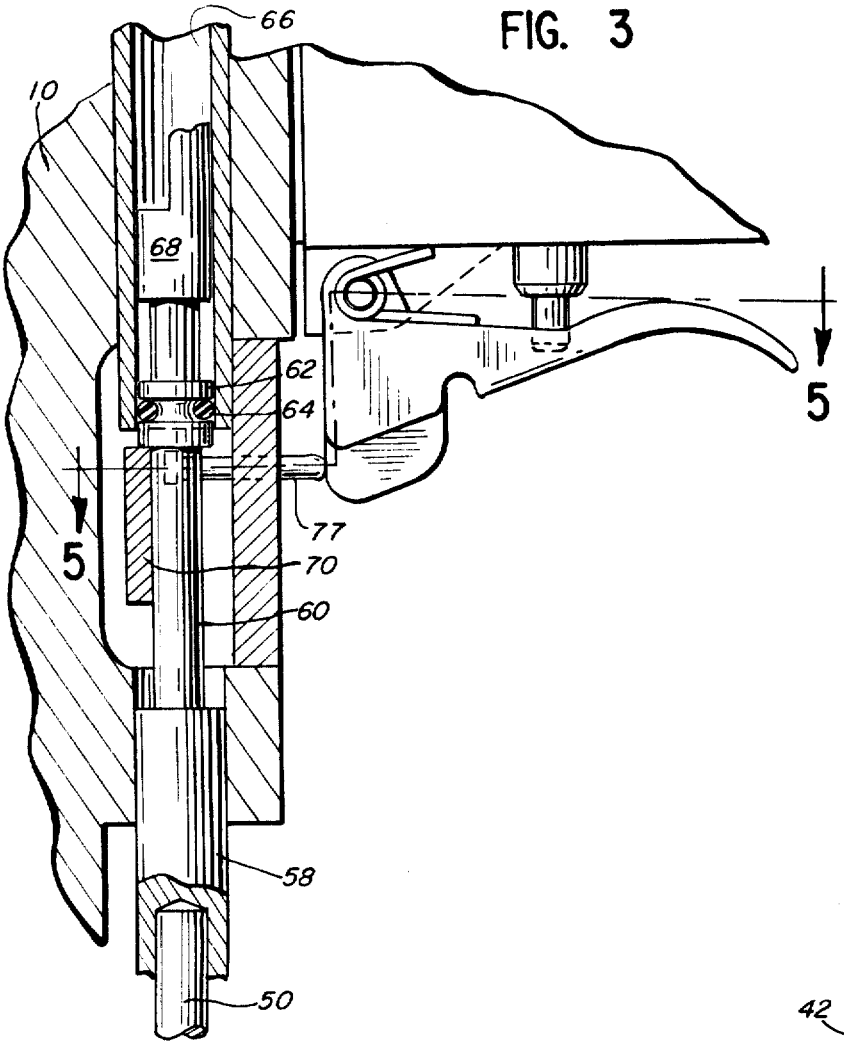
FIG. 6
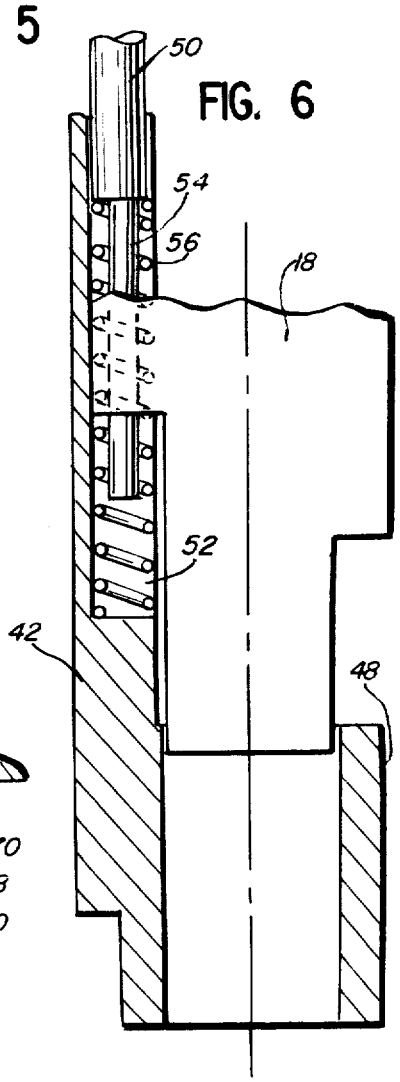
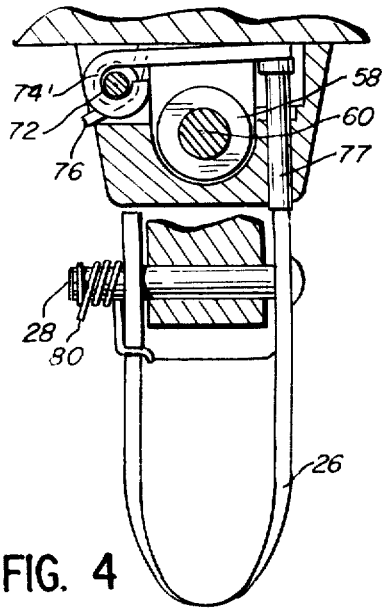
FIG. 4
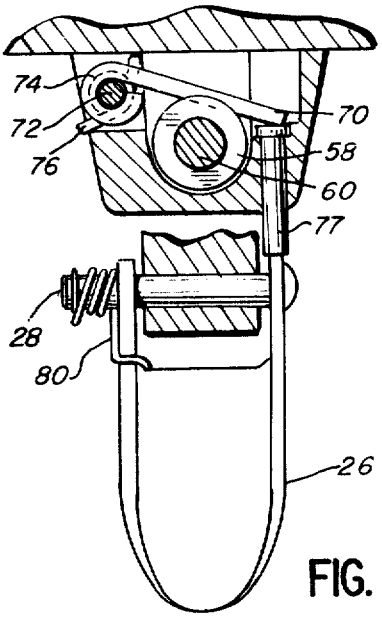
FIG. 5

FASTENER DRIVING TOOL

FIELD OF THE INVENTION

The present invention relates to a new and improved tool for driving fasteners into a workpiece and specifically to a mechanical safety for preventing actuation of the tool if not operated in the proper sequence of placing the tool on a workpiece prior to actuation of a trigger of the tool.

DESCRIPTION OF THE PRIOR ART

In fastener driving tools employed for driving fasteners of a variety of types and sizes into a workpiece, it is desirable to prevent operation of the tool unless it is placed against a workpiece prior to actuation of the trigger thereby insuring that the tool is not accidentally fired harming the operator or other persons in the vicinity of the tool. Several different types of safeties have been employed in the prior art such as pneumatic and electrically operated safeties. The least costly and more reliable safeties are often mechanical; however, many of the mechanical safeties in the prior art are complex, are often are difficult to replace or repair and are susceptible to wear reducing the reliability of the safety over a period of time. In addition, many mechanical safeties of the prior art can be defeated by pounding the tool against a workpiece. It is desirable to provide a mechanical safety that is low in cost, easily replaced or repaired and cannot be defeated by pounding of the tool against a workpiece.

SUMMARY OF THE INVENTION

An object of the present invention is to provide a new and improved tool for driving fasteners into a workpiece.

Another object of the present invention is to provide a new and improved mechanical safety for a tool employed to drive fasteners into a workpiece.

A still further object of the present invention is to provide a new and improved safety assembly for a fastener driving tool that cannot be defeated by pounding the tool against a workpiece.

Briefly, the present invention is directed to a new and improved fastener driving tool of the type that may be employed for driving fasteners into a workpiece. The tool includes a trigger assembly which upon actuation energizes the tool to drive the fastener. The tool also includes a workpiece engagement assembly that is movable from an inoperative position to an operative position upon placement of the tool on a workpiece. A safety assembly connects the workpiece engagement assembly and the trigger assembly and is actuable to prevent operation of the tool unless the proper sequence of placing the tool onto a workpiece prior to actuating the trigger assembly is followed. The safety assembly includes a blocking member or lever that blocks movement of the workpiece engagement assembly from an inoperative position to an operative position if the trigger assembly is actuated prior to placement of the tool onto a workpiece. The safety assembly also includes a compression spring and a motion transmitting linkage between the safety assembly and the workpiece engagement assembly that prevents the safety from being defeated by pounding of the tool against a workpiece.

BRIEF DESCRIPTION OF THE DRAWINGS

The above and other objects and advantages and novel features of the present invention will become apparent from the following detailed description of a preferred embodiment of the invention illustrated in the accompanying drawings wherein:

FIG. 3 is a view similar to FIG. 2 with the trigger assembly in the operative position;

FIG. 4 is a view taken along line 4—4 of FIG. 2;

FIG. 5 is a view taken along line 5—5 of FIG. 3;

FIG. 6 is an enlarged cross-sectional view of the motion transmitting linkage between the safety assembly and workpiece engagement assembly of the tool illustrated in FIG. 1.

DESCRIPTION OF THE PREFERRED EMBODIMENT

Figure 1:
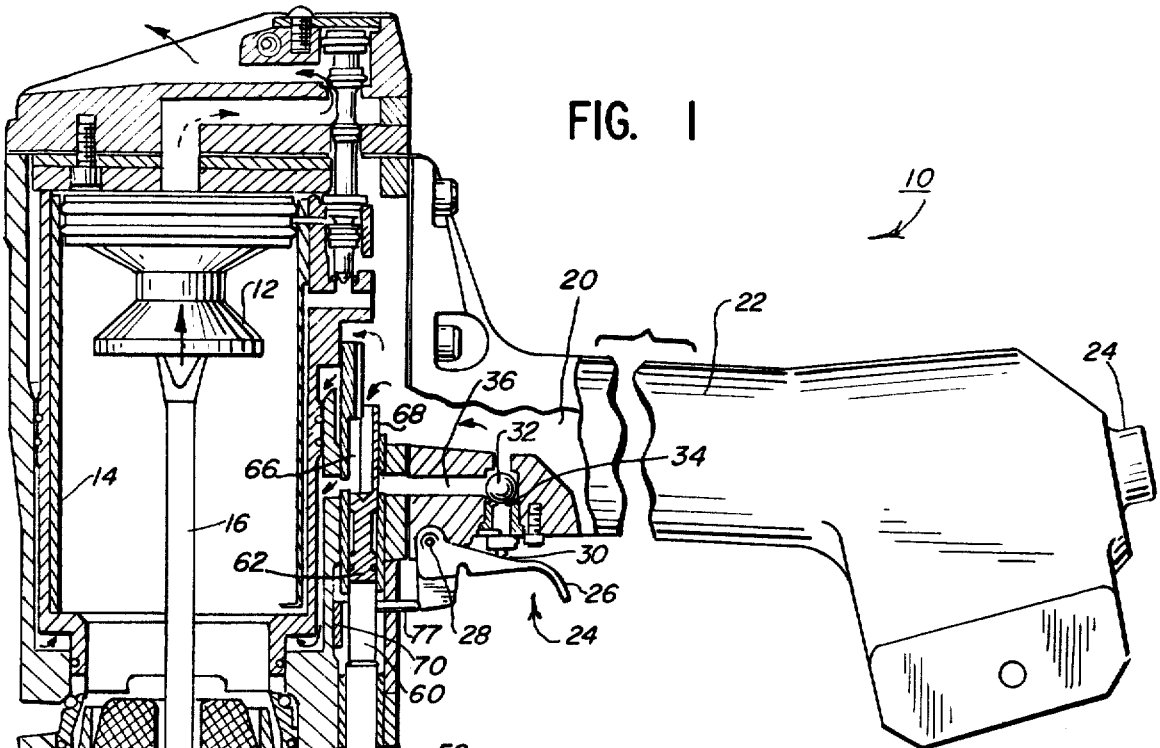
FIG. 1 is a partially sectioned view of a fastener driving tool including a safety assembly constructed in accordance with the principles of the present invention.

With reference initially to FIG. 1, there is illustrated a fastener driving tool generally designated by the reference numeral 10. The fastener driving tool 10 operates and includes driving elements substantially similar to the tool described and disclosed in U.S. Pat. No. 3,253,760 and a description of the tool and its various components may be had by reference to U.S. Pat. No. 3,253,760. Accordingly, only a description of the tool 10 sufficient for an understanding of the operation of the tool will be provided herein.

The tool 10 includes a driver piston 12 reciprocally mounted within a cylinder 14. The piston 12 is attached to a driver element 16 that is employed for driving fasteners into a workpiece. Fasteners are fed into a nosepiece structure 18 by a magazine assembly that is not shown for convenience of illustration. The lower end of the nosepiece structure 18 is placed against a workpiece into which a fastener is desired to be driven. The piston 12 is reciprocated within the cylinder 14 under the influence of pneumatic pressure contained in a reservoir 20 partially defined in the handle 22 of the tool 10. The handle 22 and the reservoir 20 are in fluid communication with a source of pressurized fluid through an inlet fitting 24 defined in the end of the handle 22.

Control of the fluid pressure within the reservoir 20 to operate or reciprocate piston 12 is provided in part by a trigger assembly generally designated by the reference numeral 24. The trigger assembly 24 includes a trigger member 26 pivotally mounted to the tool 10 by a pin 28. The trigger member 26 engages a trip pin 30 and reciprocates the trip pin within the tool 10 to move a ball valve 32 relative to a valve seat 34. In the position illustrated in FIG. 1, the ball valve 32 engages the seat 34 and is held therein under the influence of fluid pressure within the reservoir 20. Actuation of the trigger assembly 24 by pivoting of the trigger member 26 upwardly causes upward movement of the trip pin 30 moving the ball valve 32 out of engagement with the seat 34. This vents the passage 36 to atmosphere and if the tool 10 has been placed against a workpiece prior to pivoting of the trigger member 26, the piston 12 is moved downwardly driving a fastener into a workpiece. If, however, the trigger member 26 is pivoted prior to placing of the tool 10 onto a workpiece, the piston 12 is not reciprocated downwardly in a driving action for reasons to be described. Consequently, the tool 10 must first be placed against a workpiece prior to actuation of the trigger assembly 24 in order for the tool 10 to be actuated.

Figure 7:
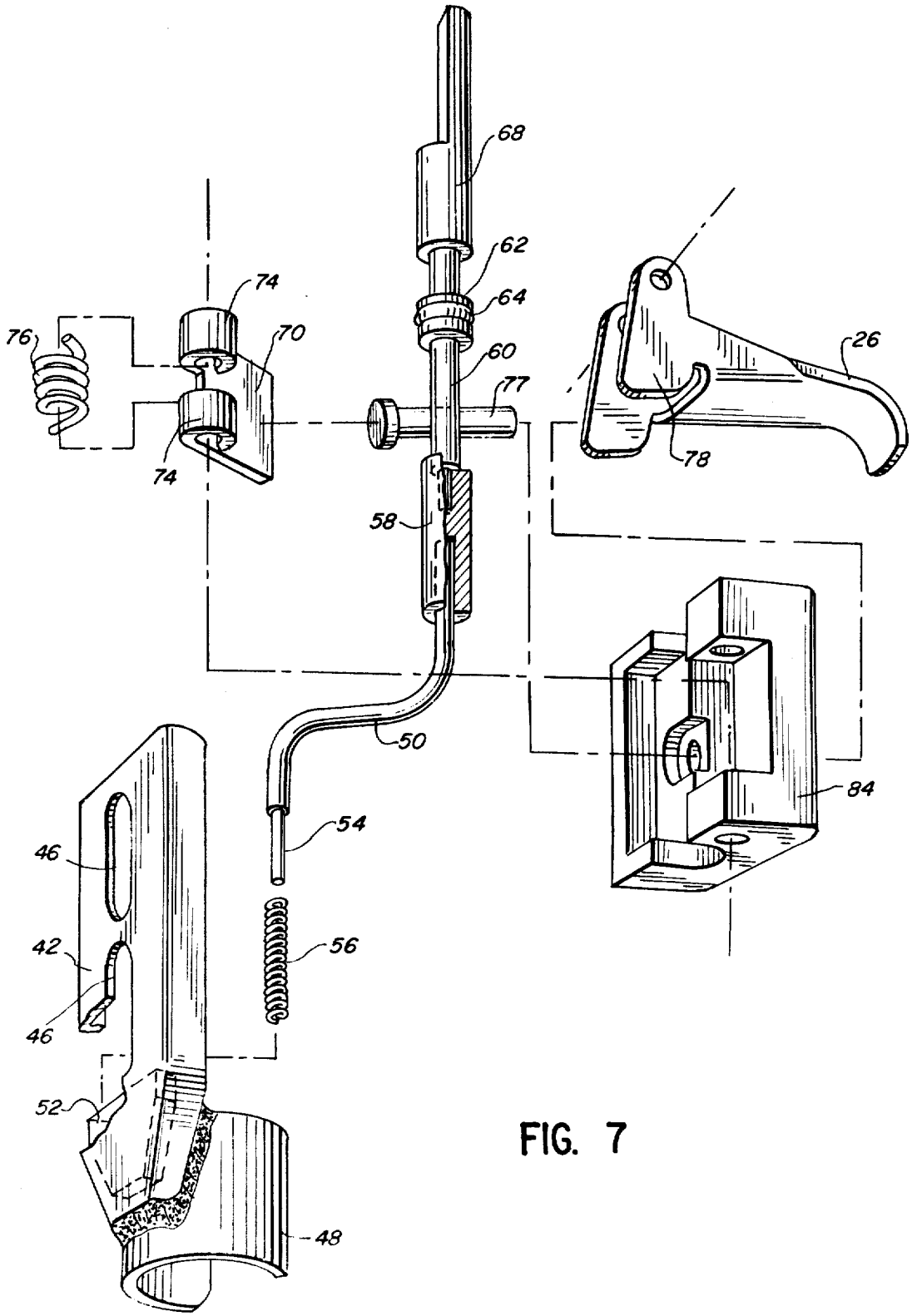
FIG. 7 is an exploded view of the trigger, workpiece engagement assembly and safety assembly of the tool of the present invention.

Prevention of the actuation of the tool 10 unless the proper sequence has been followed is insured by a workpiece engagement assembly designated by the reference numeral 38 and a safety assembly generally designated by the reference numeral 40. The workpiece engagement assembly 38 includes a plate 42 slideably mounted to the nosepiece member 18 by fasteners or bolts 44 that extend through slots 46 (FIG. 7) defined in the plate 42 and by a flange 48 that encircles the nosepiece 18 and extends below the nosepiece 18 to be engaged by the workpiece upon placement of the tool 10 onto the workpiece.

The safety assembly 40 is mechanically connected to the workpiece engagement assembly 38. Specifically, the plate 42 is connected to a yoke linkage 50 that is mounted in a recess 52 defined in the plate 42 (FIG. 6). The yoke linkage 50 includes a reduced end portion 54 that is positioned within the recess 52 and is encircled by a compression spring 56 that abuts against yoke linkage 50 at one end and the bottom of the recess 52 at the other end. The combination of the recess 52, the reduced portion 54 and the spring 56 define a motion transmitting linkage between the safety yoke 50 and the workpiece engagement assembly 38. Accordingly, if the improper sequence is followed wherein the trigger 26 is pivoted prior to placement of the tool 10 onto a workpiece, the upward movement of the safety linkage 50 is prevented in a manner to be described. If an attempt is made to defeat this prevention of upward movement of the safety linkage 50 by pounding the tool 10 and specifically the flange 48 onto the workpiece, this pounding will be absorbed by the motion transmitting linkage and specifically the spring 56, thus preventing defeating the safety 40 in a manner that typically occurs in prior art mechanical safeties.

The yoke linkage 50 is connected by a coupler 58 to a safety stem 60. The safety stem 60 includes a seal 62 (FIG. 3) encircling the upper end thereof with an O-ring 64 that slideably and sealing moves within a passage 66 defined in the tool 10 that is in fluid communication with the reservoir 20 at the upper end thereof. A sliding valve member 68 is mounted on the upper end of the safety stem 60 and slides within the passage 66. The valve 68 and the safety stem 60 therebelow control pressurized fluid flow through the passage 36. The valve stem 60 is biased downwardly by the action of pressurized fluid on the valve 68 to the position of the valve 68 illustrated in FIG. 1 wherein the passage 36 is closed and the tool 10 is in the static or inoperative position. If the tool 10 is placed upon a workpiece prior to pivoting of the trigger member 26, the plate 42 slides upward along the nose portion 18. This movement is transmitted through the yoke linkage 50 causing upward movement of the valve 68 until the reduced portion of the safety stem 60 below the valve 68 is positioned adjacent the passage 36. This allows flow through the passage 36 and if the trigger member 26 is actuated thereafter lifting the ball 32 out of its seat 34 through the action of the pin 30, the passage 36 is vented to atmosphere resulting in firing of the tool 10 and driving a fastener into the workpiece.

If the tool 10 is actuated in the improper sequence wherein the trigger member 26 is pivoted prior to the placement of the tool 10 onto a workpiece, the tool 10 will not be actuated. This is accomplished through the provision of a blocking member or lever 70. The blocking lever 70 is pivotally mounted on a pin 72 by circular flanges 74 (FIG. 7) defined thereon. The lever 70 is biased outwardly by a spring 76 to a position to engage the safety stem 60. This position is illustrated in FIGS. 3 and 5 wherein the lever 70 overlies the connector 58 and abuts the safety stem 60 such that if the the tool 10 is placed onto a workpiece, upward movement will be blocked by engagement of the connector 58 with the lever 70.

Figure 2:
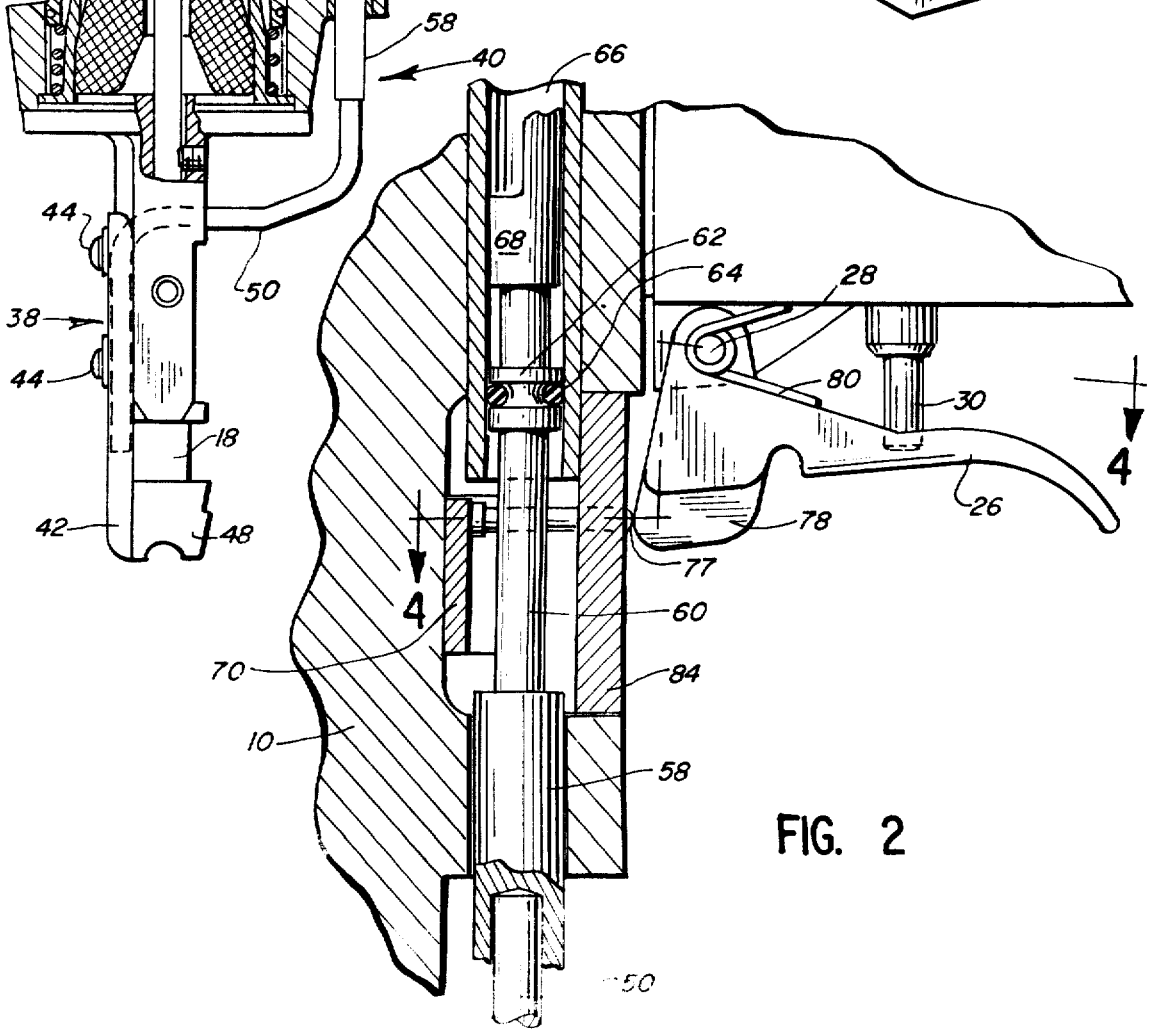
FIG. 2 is an enlarged cross-sectional view of the trigger and safety assemblies of the tool illustrated in FIG. 1 where the trigger and safety assemblies are in the inoperative positions.

The lever 70 is maintained in a non-blocking position as illustrated in FIGS. 2 and 4 by a pin 77 that abuts the lever 70 at one end and abuts a lobe 78 defined on the trigger member 26 at the other end. The trigger member 26 is biased downwardly as illustrated in FIG. 2 by a spring 80 that is wrapped around the pin 28. The spring 80 is of greater strength than the spring 76 such that in the inoperative or static position, the spring 80 biases the trigger member 26 downwardly to the position illustrated in FIG. 2 wherein the lobe 78 engages the pin 77 pushing the lever 70 to the non-blocking position. As the trigger member 26 is pivoted upwardly about the pin 28, the pin 77 and the lever 70 are moved outwardly under the influence of the spring 76 to the position illustrated in FIGS. 3 and 5. The lever 70, the pin 77, the coupler 58 and the stem 60 are all covered by a housing 84 that is removably secured to the tool 10. If the tool 10 is placed on a workpiece prior to pivoting of the trigger member 26, the lever 70 is pivoted outwardly by the spring 76; however, it engages the side of the connector 58 which has already been moved upward and does not prevent upward movement of the safety yoke 50. Thereafter, if the trigger member 26 is pivoted, the passage 36 is vented to atmosphere by lifting of the ball and the tool 10 is fired.

What is claimed and sought to be secured by Letters Patent of the United States is:

1. In a fastener driving tool for driving fasteners into a workpiece, the improvement comprising:

a trigger assembly movable from an inoperative position to an operative position to control operation of the tool, a workpiece responsive assembly movable from an inoperative position to an operative position as the tool is moved adjacent a workpiece, and a safety control assembly coupling said trigger assembly and said workpiece responsive assembly to control operation of the tool, said safety control assembly including means coupled to said workpiece responsive assembly for actuating said tool and a blocking member for blocking movement of said actuating means to an operative position and (1) positioned in a non-blocking position in response to movement of both said trigger and workpiece responsive assemblies to their operative positions for effecting operation of said tool to drive a fastener, and (2) positioned in a blocking position in response to movement of the trigger assembly to its operative position prior to movement of the workpiece responsive assembly to its operative position.

2. The tool set forth in claim 1 wherein said blocking member comprises a lever pivotally mounted on said safety control member.

3. The tool set forth in claim 1 further comprising biasing means for biasing said blocking member to said blocking position.

4. The tool set forth in claim 1 further comprising means for mechanically coupling said trigger assembly and said blocking member.

5. The tool set forth in claim 4 wherein said mechanical coupling means comprises a pin slidably mounted on said safety control assembly including a first end adjacent said trigger assembly and a second end adjacent said blocking member.

6. In a fastener driving tool of the type including a driver for driving fasteners into a workpiece and means for actuating said driver, the improvement comprising:

a trigger assembly including a trigger member pivotally mounted on said tool, a safety assembly movable from a tool inoperative position to a tool operative position, said safety assembly including means for actuating said tool and a workpiece engagement member movable from an inoperative position to an operative position upon engagement with a workpiece, and means blocking said actuating means movably mounted on said tool, said blocking means actuable by said trigger member to prevent actuation of said tool upon actuation of said trigger member prior to engagement of said workpiece engagement member with said workpiece.

7. The tool claimed in claim 6 wherein said blocking means comprises a lever pivotally mounted on said safety assembly.

8. The tool claimed in claim 6 further comprising a pin slidably mounted on said safety assembly and mechanically coupling said trigger member and said blocking means.

9. The tool claimed in claim 6 wherein said safety assembly further comprises a linkage member slidably coupled to said workpiece engagement member and adjacent said blocking means, and resilient connection means for connecting said linkage member and said workpiece engagement member.

10. A fastener tool of the type including a driver for driving a fastener into a workpiece and an actuation assembly for actuating said driver, comprising:

a trigger assembly mounted on said tool movable from an inoperative position to an operative position, a workpiece engagement member movable from an inoperative position to an operative position upon engagement with a workpiece, and a safety assembly mechanically connecting said trigger assembly and said workpiece engagement member, said safety assembly including an actuating member for actuating said actuation assembly upon movement of both said trigger assembly and said workpiece engagement member to their operative positions, a lever pivotally mounted on said safety assembly, said trigger assembly mechanically coupled to said lever to transmit movement of said trigger assembly to said lever and first means for biasing said lever to engage said actuating member and preventing actuation of said actuation assembly upon movement of said trigger assembly prior to movement of said workpiece engagement member.

11. The tool set forth in claim 10 further including a pin slideably mounted on said safety assembly with a first end adjacent said trigger assembly and a second end adjacent said lever, and second means for biasing said trigger assembly to said inoperative position and biasing said lever out of engagement with said actuating member.

12. The tool set forth in claim 10 further comprising a resilient coupling means for coupling said workpiece engagement member and said actuating member to allow movement of said workpiece engagement member relative to said safety assembly upon engagement of said lever and said actuating member.

* * * * *